US012540787B2

(12) United States Patent
Genna et al.

(10) Patent No.: US 12,540,787 B2
(45) Date of Patent: Feb. 3, 2026

(54) METHOD OF BLANK FIRING

(71) Applicant: Centre Firearms Co., Inc., Ridgewood, NY (US)

(72) Inventors: Steven Genna, Ridgewood, NY (US); Juan D. Cabrera, Ridgewood, NY (US); Richard Ryder Washburn, III, Ridgewood, NY (US)

(73) Assignee: Centre Firearms Co., Inc., Ridgewood, NY (US)

( * ) Notice: Subject to any disclaimer, the term of this patent is extended or adjusted under 35 U.S.C. 154(b) by 0 days.

(21) Appl. No.: 18/765,962

(22) Filed: Jul. 8, 2024

(65) Prior Publication Data

US 2024/0361097 A1 Oct. 31, 2024

Related U.S. Application Data

(63) Continuation of application No. 17/818,121, filed on Aug. 8, 2022, now Pat. No. 12,031,792.

(51) Int. Cl.
*F41A 33/00* (2006.01)
*F41A 21/32* (2006.01)

(52) U.S. Cl.
CPC ..... *F41A 33/00* (2013.01); *F41A 21/32* (2013.01)

(58) Field of Classification Search
CPC ..... F41A 33/00; F41A 21/32
USPC ..... 42/76.01
See application file for complete search history.

(56) References Cited

U.S. PATENT DOCUMENTS 2,635,378 A 4/1953 Pinckney et al.
3,448,513 A * 6/1969 Best ..... B28B 1/00 264/154
5,983,772 A * 11/1999 Reynolds ..... F41A 21/10 42/77
6,016,735 A * 1/2000 Langner ..... F41J 13/00 89/917
6,128,847 A * 10/2000 Langner ..... F41A 17/54 42/70.07
6,732,628 B1 * 5/2004 Coburn ..... F41J 13/00 89/917
7,444,775 B1 11/2008 Schuetz
8,156,855 B2 4/2012 Anderson
(Continued)

FOREIGN PATENT DOCUMENTS

CA 2665565 A1 11/2010
EP 2657640 B1 * 11/2021 ..... F41A 21/26
(Continued)

OTHER PUBLICATIONS

International Search Report and Written Opinion for PCT/US2023/071722 dated Nov. 6, 2023, 12 pages.

*Primary Examiner* — Samir Abdosh
(74) *Attorney, Agent, or Firm* — Duane Morris LLP

(57) ABSTRACT

A method of firing a firearm includes providing a blank firing adapter plus bullet trap attached to the end of a barrel of the firearm, the blank firing adapter plus bullet trap including a bore aligned with a longitudinal axis of the barrel; providing a magazine that limits loading of up to two live rounds; and arranging for a blast from a cartridge in the firearm to eject a shell casing from the cartridge and automatically operate the firearm to insert a new cartridge from the magazine into a chamber of the firearm.

15 Claims, 6 Drawing Sheets

(56) References Cited

U.S. PATENT DOCUMENTS

| | | | | |
|---|---|---|---|---|
| 8,296,989 | B1 * | 10/2012 | Hawthorne | F41C 27/06 42/105 |
| 8,677,672 | B2 * | 3/2014 | Kennedy | F41A 21/32 42/96 |
| 8,910,411 | B1 * | 12/2014 | Calvert | F41A 21/325 42/105 |
| 2002/0134273 | A1 * | 9/2002 | Mihaylov | F42B 14/04 102/439 |
| 2012/0272558 | A1 * | 11/2012 | Pitacco | C23C 16/045 42/78 |
| 2014/0013985 | A1 * | 1/2014 | Kravel | F42B 12/48 102/485 |
| 2014/0173963 | A1 * | 6/2014 | Kent | F41A 21/32 42/90 |
| 2016/0178305 | A1 * | 6/2016 | Ellis | F41A 21/34 42/90 |
| 2021/0048273 | A1 * | 2/2021 | Kireev | F41A 21/32 |
| 2021/0222986 | A1 * | 7/2021 | James | F41A 21/32 |

FOREIGN PATENT DOCUMENTS

| | | | | |
|---|---|---|---|---|
| WO | WO-2008128276 | A1 * | 10/2008 | F41A 21/26 |
| WO | WO-2023028700 | A1 * | 3/2023 | F41A 21/26 |

* cited by examiner

METHOD OF BLANK FIRING

CROSS REFERENCE TO RELATED APPLICATIONS

This application claims the benefit of U.S. patent application Ser. No. 17/818,121, filed Aug. 8, 2022, the entire contents of each of which is incorporated by reference for all purposes as if fully set forth herein.

BACKGROUND

The present disclosure relates to a blank firing system and methods of bland firing. More specifically, the present invention relates to a blank firing system that includes a barrel, a blank firing adapter having a bullet trap, and a magazine and method of firing the same.

Training in the use of firearms can be made safer and less costly by utilizing blank rather than live ammunition. Training with blank ammunition allows an operator to become familiar with weapon functioning, cleaning, maintenance procedures, etc. without the risk of using live ammunition. Training of groups of operators with firearms configured only to shoot blank ammunition allows teams to practice movements and tactics with less risk of injuring a teammate or accidentally discharging a live round.

Semi-automatic and automatic firearms depend on high pressures in the chamber generated by the combustion of the propellant to push the breech block to the rear, allowing another round to be chambered and fired. If a blank round is used, there is no bullet to seal the barrel, and the combustion gases exit through the muzzle without building up enough pressure to rechamber the next round. Because blank cartridges generate very little recoil, far less than that produced by a live round, the recoil operation mechanism in such firearms is not suitable for use with blank ammunition. Since there is no bullet when using blank ammunition, a blank firing adapter (BFA) must be used to create the pressures necessary to make semi-automatic and automatic firearms operate normally. A BFA is a device that is configured to fit over the muzzle of a firearm barrel and inhibit the flow of propellant gases to allow blank ammunition to provide enough backpressure to properly cycle a semi-automatic or automatic firearm.

BFAs normally consist of a bore restricting device placed on the muzzle of a firearm. The BFA limits the escape of gases generated by the firing of blank rounds. The restricted gas flow simulates the effect of a bullet in the bore. The firearm will then cycle in the designed manner as if live ammunition is being used.

However, there is an ever present risk of inadvertently feeding a live round into a firearm during simulation or training. This presents an extremely dangerous condition when using a BFA. A live round fired through a BFA can send shrapnel from the BFA and splintered round in all directions. This becomes a potential danger to the operator and any other personnel in the area.

SUMMARY

To overcome the problems described above, preferred embodiments of the present disclosure provide a blank firing system that includes a blank firing adapter plus features that can stop a live round that was accidentally fired i.e., a bullet trap (BFA+), a barrel having a smooth bore at least a portion of a length of the barrel, and a customized magazine used with blank rounds.

In an embodiment, a method of trapping a bullet fired from a firearm includes providing a barrel having a smooth bore at least a portion of its length on the firearm; providing a blank firing adapter plus bullet trap attached to the end of the barrel, the blank firing adapter plus bullet trap including a bore aligned with a longitudinal axis of the barrel; arranging for a blast in the firearm to cause a bullet to travel in the barrel in a direction parallel to the longitudinal axis of the barrel toward the blank firing adapter plus bullet trap; and stopping the bullet in the blank firing adapter plus bullet trap.

In an aspect, the smooth bore extends most of the length of the barrel.

In an aspect, the blank firing adapter plus bullet trap includes a chamber to trap the bullet fired from the firearm.

The method can further include stopping a plurality of bullets consecutively fired from the firearm.

The method can further include allowing gas created by allowing the blast in the firearm to escape through a port of the blank firing adapter plus bullet trap.

The method can further include adjusting a pressure of the gas by changing a size of the port.

The method can further include providing a magazine that limits loading of up to two live rounds.

In an aspect, the magazine is configured to accept a stack of blank rounds and a maximum of two live rounds.

The method can further include ejecting a shell casing from the bullet and automatically operating the firearm to insert a new cartridge into a chamber of the firearm.

In another embodiment, a method of firing a firearm includes providing a blank firing adapter plus bullet trap attached to the end of a barrel of the firearm, the blank firing adapter plus bullet trap including a bore aligned with a longitudinal axis of the barrel; providing a magazine that limits loading of up to two live rounds; and arranging for a blast from a cartridge in the firearm to eject a shell casing from the cartridge and automatically operate the firearm to insert a new cartridge from the magazine into a chamber of the firearm.

In an aspect, the blank firing adapter plus bullet trap is configured to trap one or more bullets consecutively fired from the firearm.

In an aspect, the magazine includes a stop that limits acceptance of the up to two live rounds.

In an aspect, most but not all of a bore of the barrel is smooth.

The method can further include allowing gas created by the blast to escape the firearm through a port of the blank firing adapter plus bullet trap.

The method can further include adjusting a back pressure of the gas by changing a size of the port.

The above and other features, elements, characteristics, steps, and advantages of the present invention will become more apparent from the following detailed description of preferred embodiments of the present invention with reference to the attached drawings.

BRIEF DESCRIPTION OF THE DRAWINGS

The features and advantages of the present disclosures will be more fully disclosed in, or rendered apparent by the following detailed descriptions of example embodiments. The detailed descriptions of the example embodiments are to be considered together with the accompanying drawings wherein like numbers refer to like parts and further wherein.

DETAILED DESCRIPTION

In the following description, reference is made to the accompanying drawings that form a part thereof, and in which is shown by way of illustrating specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense. For example, an AK-style firearm is used to show and describe features of the present disclosure, although any other suitable style or model of firearm can include the disclosed blank firing system.

Figure 1:
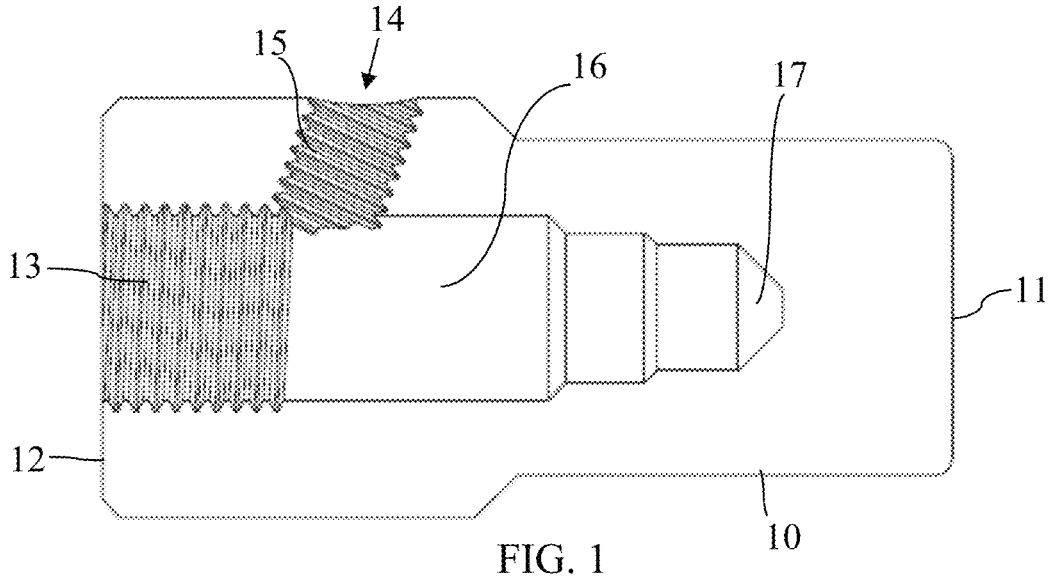
FIG. 1 is a side sectional view of a BFA+ device according to an embodiment of the present disclosure.

FIG. 1 is a side sectional view illustrating a BFA+ device 10 according to an embodiment of the present disclosure. FIG. 1 shows that the BFA+ can include a first end 11 that can be a blunt end and a second end 12 that can be an attachment end. The second end 12 can be attached to the muzzle of a gun barrel. FIG. 1 shows that the second end 12 can include internal threads 13 used to screw the BFA+ 10 to the end of a gun barrel. The second end 12 of the BFA+ device 10 can include threads, a bayonet mount, a countersink, or be adapted in any suitable way to match and be configured to mount to a particular gun barrel. Therefore, the BFA+ device 10 can be screwed on, soldered, welded, press fit, clamped, or locked down in any way such that it will stay in place and perform during use.

FIG. 1 also shows that the BFA+ 10 can include an exhaust port 14, an opening in the BFA+ 10 that can allow propellant gas to escape. The exhaust port 14 is used to control the release of gases created during the firing of the gun. As shown, the exhaust port 14 includes threads 15, although this is not required. The threads 15 of the exhaust port 14 can be used to install various sized plugs or valves (not shown) used to meter or change the pressure of exhausted gas and corresponding back pressure. An exhaust port plug can be solid or can include different diameter holes to allow some gas to escape. A valve can be adjustable and used to adjust how much gas escapes. As such, the back pressure of the exhaust gas can be varied to match the particular gun and the blank rounds being fired. That is, a portion of the exhaust gas can be used to chamber the next blank round after a blank round has been fired.

In FIG. 1, the exhaust port 14 is shown at about a 70 deg. angle with relation to a longitudinal axis of the BFA+ 10, but other angles can be used. For safety reasons, it is preferred that the exhaust port 14 is angled away from the operator. Therefore, any hot toxic escaping gases will be angle away from the operator. Additionally, if a plug mounted inside the exhaust port 14 fails and blows out when a round is filed to become a projectile, it will be directed away from the operator.

FIG. 1 also shows that the BFA+ 10 includes a cavity 16 (bullet trap) that is a hollow cavity within the BFA+ 10 used to capture a bullet from a live round inadvertently shot from a gun in which the BFA+ 10 is mounted. The bullet will exit the gun barrel, but be stopped in the cavity 16 of the BFA+ device 10. Thus, safety is increased during use as an accidental discharge of a live round will be contained. As shown, the cavity 16 is round and tapered away from the second end 12. Reducing the diameter of the cavity 16 can be used to absorb energy from the fired bullet before stopping the bullet completely. That is, the diameter of the cavity 16 can be reduced or tapered as the cavity 16 extends away from the end of the gun barrel. Although tapering can be gradual, reduction of the cavity diameter can be done by reducing the diameter of the cavity 16 in multiple steps before the cavity 16 terminates. As shown in FIG. 1, the diameter of the cavity 16 can be reduced in two steps before the cavity 16 terminates in a conical portion 17.

In order to safely trap a bullet, the body of the BFA+ 10 must be strong enough to absorb the bullet impact without breaking apart. The BFA+ 10 can be made of a 4140 or 4130 chromium-molybdenum alloy, a steel alloy, or any other suitable material.

Figure 2A:
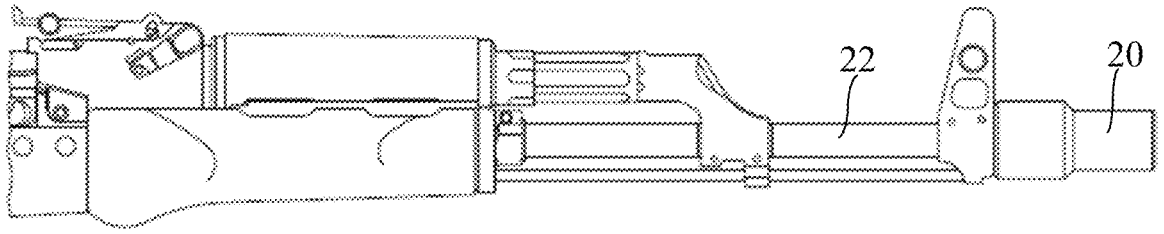
FIG. 2A and FIG. 2B are side sectional views illustrating a BFA+ device mounted at the muzzle end of a gun barrel.
Figure 2B:
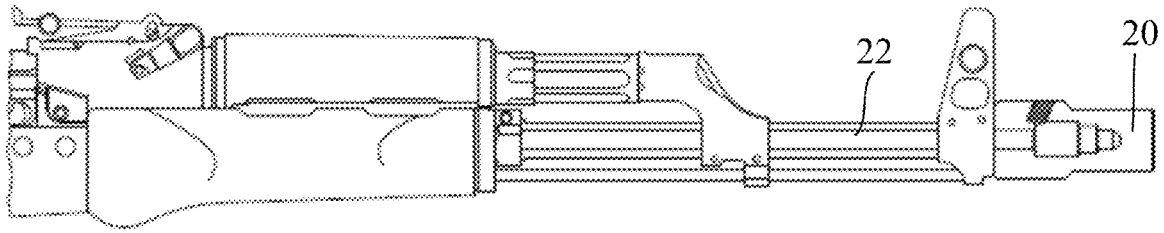
Figure 3:
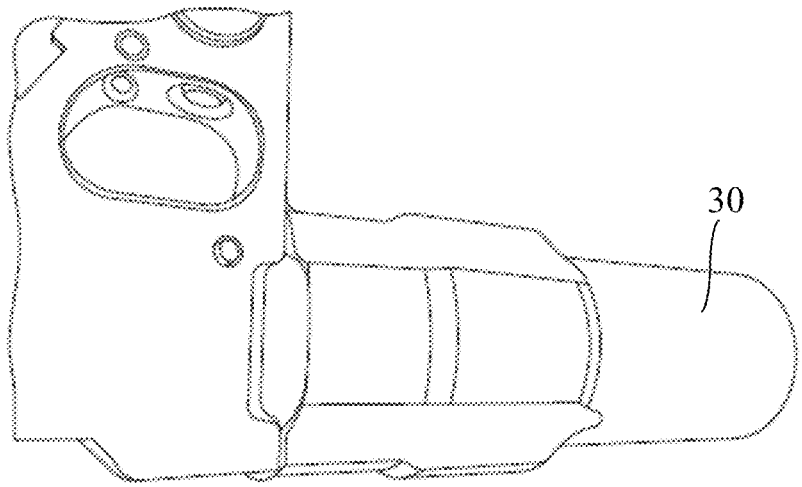
FIG. 3 illustrates a BFA+ device welded to the end of a gun barrel.

FIG. 2A shows a BFA+ 20 attached to an end of a gun barrel 22. FIG. 2B shows a sectional view of the BFA+ 20 on the gun barrel 23 as shown in FIG. 2A. The BFA+ 20 is different from the BFA+ of FIG. 1 in that the BFA+ 20 does not include threads used to mount the BFA+ 20 to the gun barrel 22. Instead, the BFA+ 20 is welded to the gun barrel 22 such as in the example shown in FIG. 3. FIG. 3 is a closer view of a BFA+ 30 welded to an end of a gun barrel.

Figure 4A:
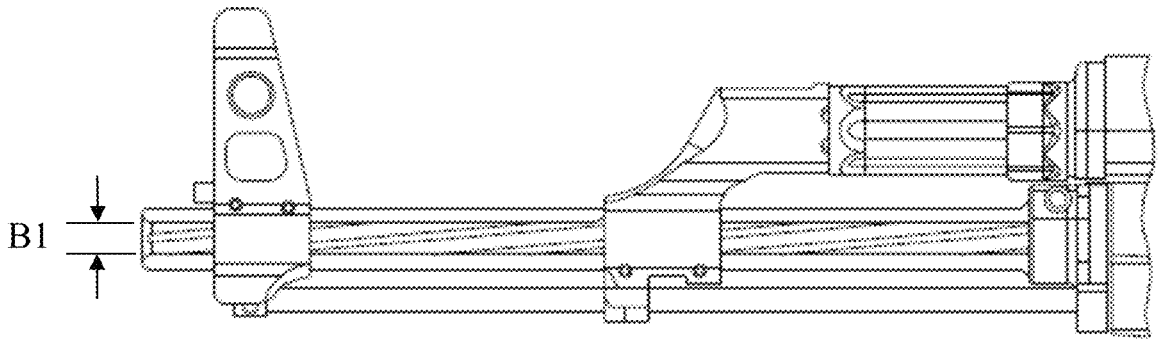
FIG. 4A and FIG. 4B are side sectional views illustrating modification of a bore of a gun barrel.
Figure 4B:
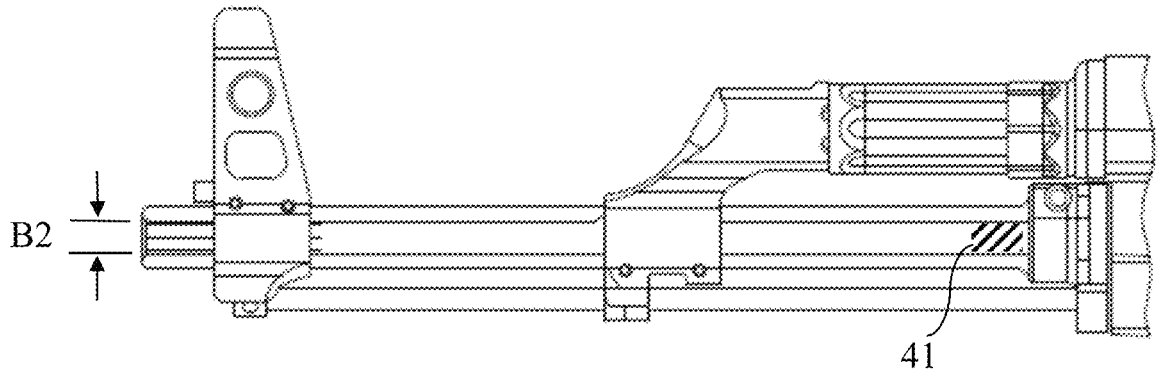

FIGS. 4A and 4B illustrate how the bore of a gun barrel can be modified to be expanded to accompany a BFA+ device as part of the blank firing system. For example, prior to modification, the bore B1 of the gun barrel in FIG. 4A can have a 0.300" land diameter and a 0.308" groove diameter. After modification, as shown in FIG. 4B, the bore B2 can have a 0.345" diameter through most of the bore length. The bore is drilled out through most but not the entire length is to allow gases to escape ahead of a projectile should a live round accidently be introduced. This will help the bullet trap capture the round as the round will not reach its potential full velocity. One report noted a 900 ft/s reduction in speed due to the removal of rifling (originally ~2400 ft/s). The bore cannot be fully drilled out because the associated gun would have to be reclassified under the National Firearms Act as a smooth-bore rifle. About one inch of rifling 41 should be left, preferably at the end of the barrel closest to the chamber.

Figure 5:
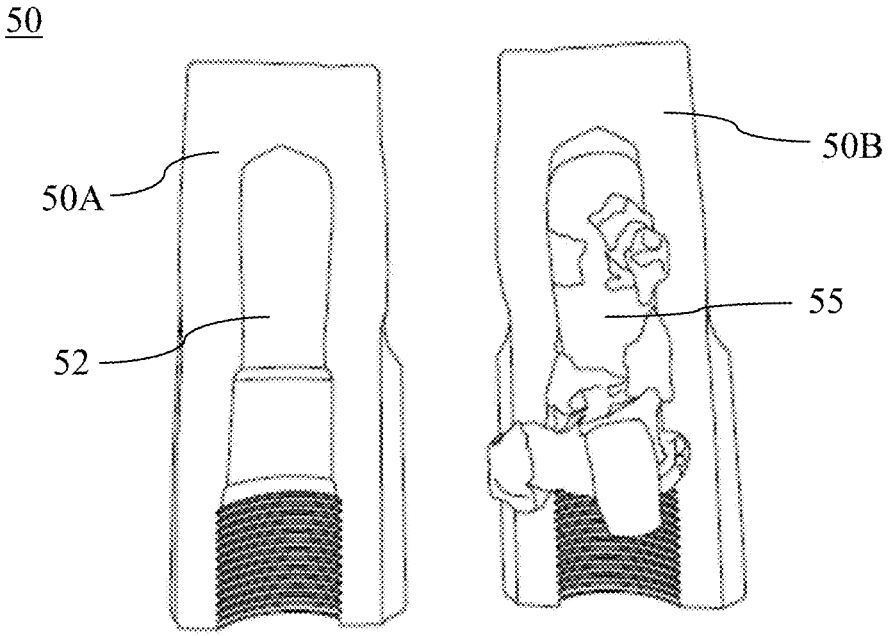
FIG. 5 and FIG. 6 are sectional views of a BFA+ device after live fire testing.
Figure 6:
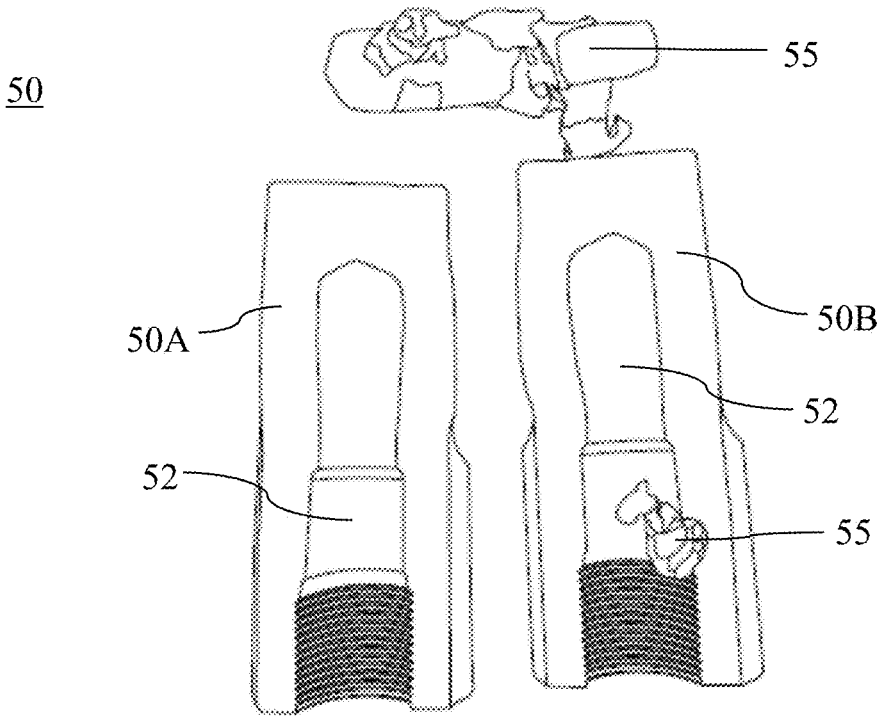

FIGS. 5 and 6 are illustrate a sectioned BFA+ device 50 after testing with live rounds. FIG. 5 shows two pieces of the BFA+ device 50A and 50B after the BFA+ device 50 was cut in half. As shown, lead 55 from multiple rounds was trapped in the cavity 52 of the BFA+ device 50. FIG. 6 shows most of the lead 55 separated from the two pieces of the BFA+ device 50A and 50B without significant damage to the BFA+ device 50.

FIGS. 7-10 are views of an exemplary curved detachable box magazine 70 according to the present disclosure. A magazine is an ammunition storage and feeding device for a repeating firearm. A magazine can be either integral within the gun (i.e., internal/fixed magazine) or externally attached (i.e., detachable magazine). The magazine functions by holding several cartridges within itself and sequentially pushing each one into a position where it may be readily loaded into the barrel chamber by the firearm's moving action.

Box magazines can be integral to the firearm or removable. A detachable box magazine is a self-contained mechanism capable of being loaded or unloaded while detached from the host firearm. The detachable box magazine is attached via a slot in the firearm's receiver. When necessary, the magazine can easily be detached from the firearm and replaced by another. This significantly speeds the process of reloading, allowing the operator quick access to ammunition. This type of magazine can be straight or curved (as shown), the curve being necessary if the firearm uses rimmed ammunition or ammunition with a tapered case. Detachable box magazines can be metal or plastic. The plastic magazines are sometimes partially transparent so the operator can easily check the remaining ammunition.

Firearms using detachable magazines are made with an opening known as a magazine well into which the detachable magazine is inserted. The magazine well locks the magazine in position for feeding cartridges into the chamber of the firearm, and requires a device known as a magazine release to allow the magazine to be separated from the firearm.

Although the exemplary magazine 70 shown is a detachable box type magazine, a magazine of the blank firing system of the present disclosure can have any suitable outline or configuration that is compatible with a firearm that includes the blank firing system.

Figure 7:
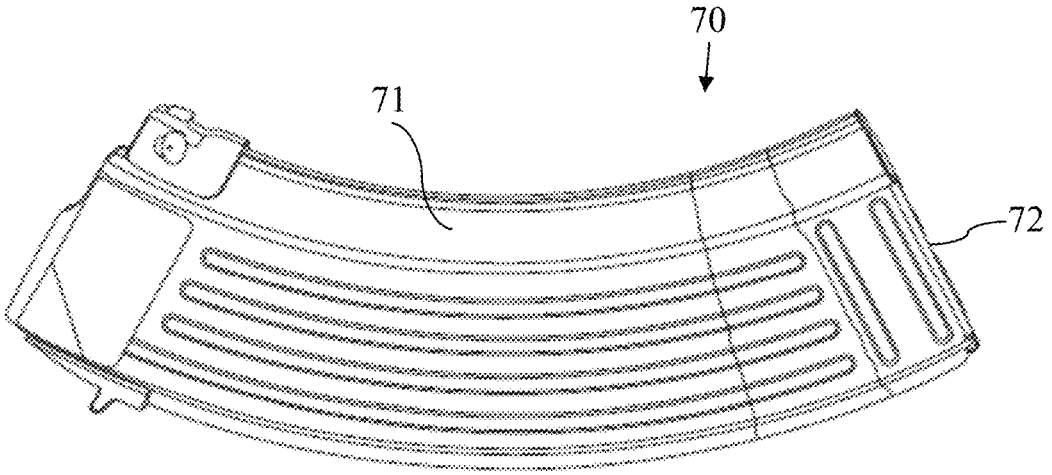
FIG. 7 and FIG. 8 are side views of an exemplary curved detachable box magazine.
Figure 8:
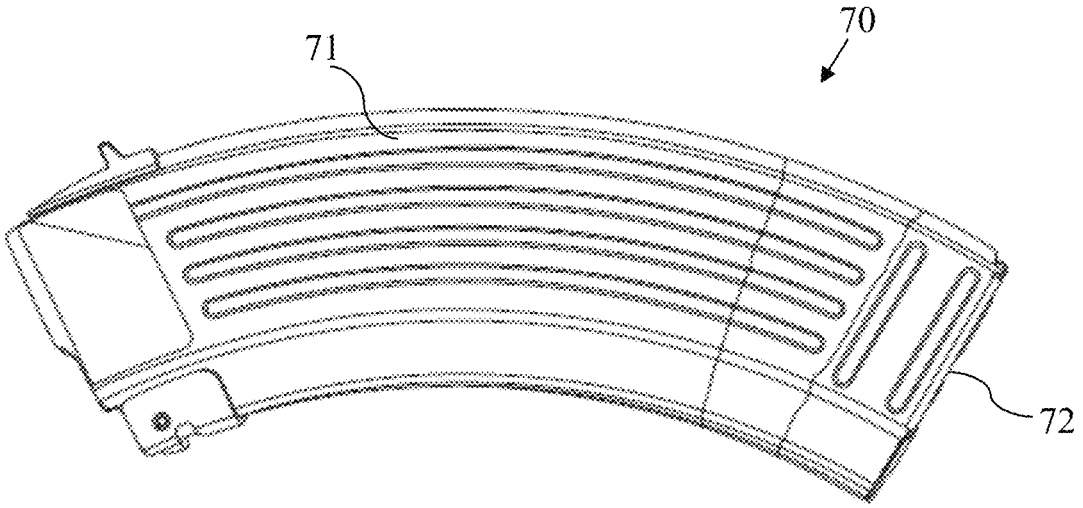
Figure 9:
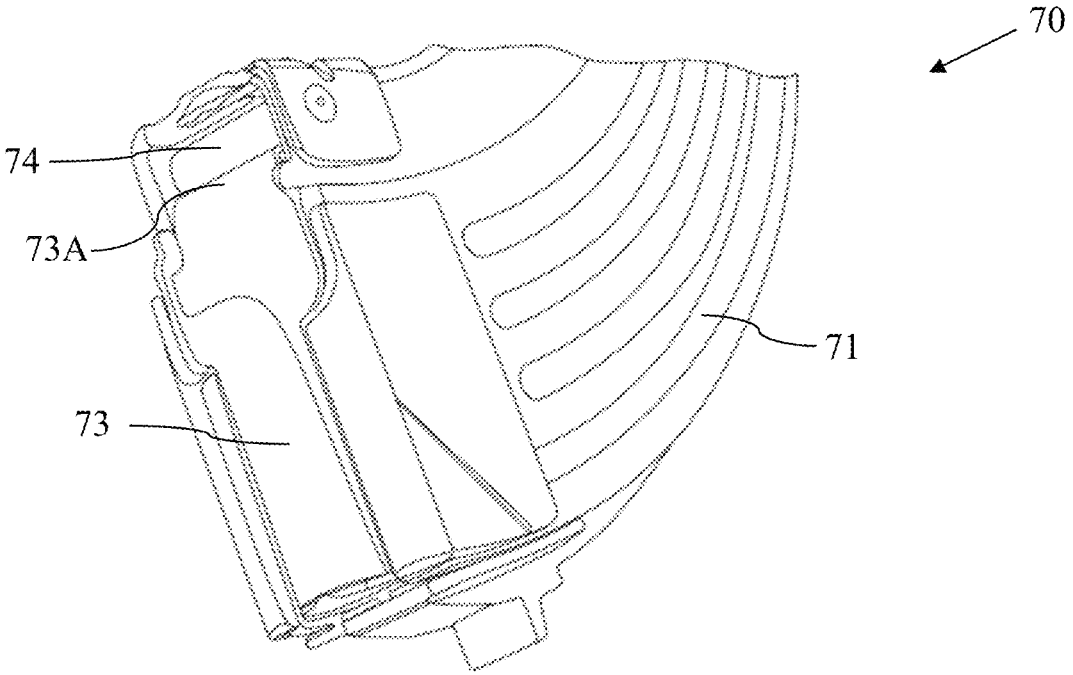
FIG. 9 is a perspective view of a magazine.
Figure 10:
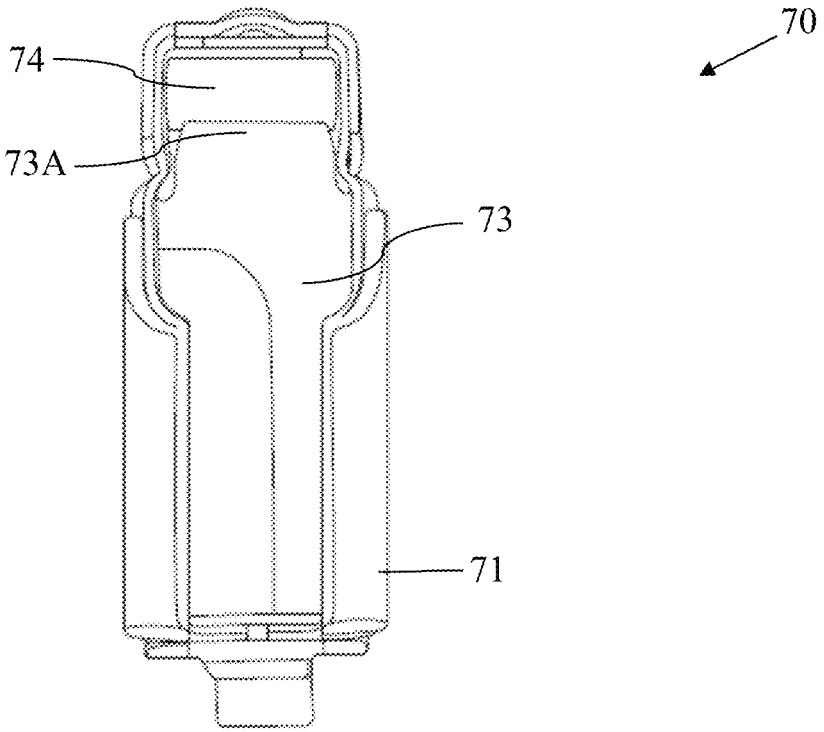
FIG. 10 is a top view of a magazine.

FIGS. 7 and 8 are opposite side views of an exemplary curved detachable box magazine 70 according to the present disclosure. FIG. 9 is a perspective view of the magazine 70. FIG. 10 is a top view of the magazine 70. The magazine 70 can have a body 71, a base 72, a spring (not shown), a spring follower 73, and a stop 74.

The body 71 can have a substantially rectangular cross section shape and can have a width to accommodate a single row (single stack) or a dual row (dual stack) of cartridges. The exemplified magazine 70 can accommodate a dual row of cartridges.

The base 72 or floor plate encloses the body 71 at one end. An internal magazine spring (not shown) rests against the base 72 and creates pressure between the base 72 and the follower 73. The follower 73 is the internal part of the magazine 70 that the cartridges rest upon. In a box magazine, such as magazine 70, the follower 73 is a moving platform attached to or securely resting atop the magazine spring. The magazine spring pushes the follower 73 and any loaded cartridges away from the base 72 and toward the mouth of the magazine 70 to facilitate feeding rounds into the firearm. The follower 73 is what physically forces cartridges into the upper receiver from the lower receiver of the firearm. FIGS. 9 and 10 show that the follower 73 can have a contour of a cartridge on one side to keep alignment of cartridges in the magazine 70 correct in order to prevent cartridge jams during firing.

FIGS. 9 and 10 also show that the magazine 70 can include a stop 74. As shown, the stop 74 can have a cylindrical cross-sectional shape such a roller or pin. Optionally, the stop 74 can have any suitable shape. The stop 74 can be made by inserting a metal pin through the body 71 of the magazine 70 and then through the cylinder. In one example, a ¼" hole is drilled through both sides of the front of the magazine feeding recess. For example, the metal pin can have a ¼" diameter. For example, the cylinder can have an ID of ¼" and an OD of ½". The metal pin can be peened, welded, tacked, or secured in place on both sides of the magazine 70 by any suitable technique.

Figure 11:
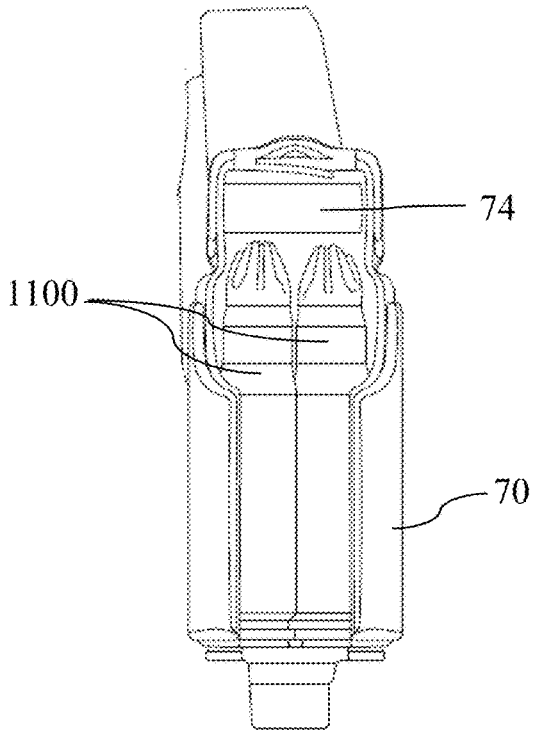
FIG. 11 is a top view of a magazine including blank rounds.
Figure 12:
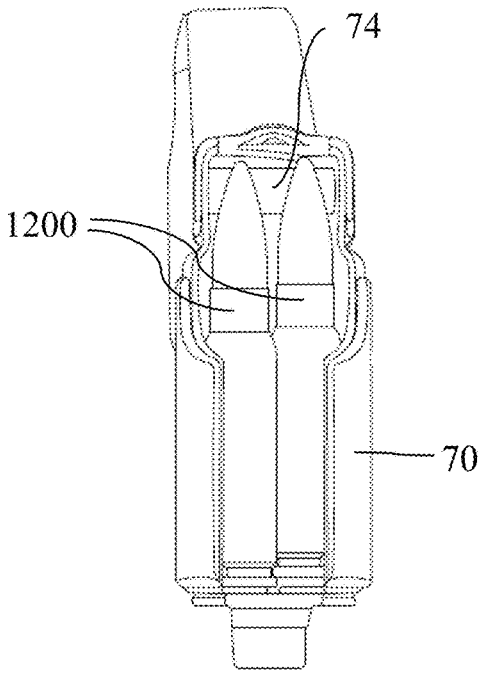
FIG. 12 is a top view of a magazine including live rounds.

The stop 74 is positioned and sized to accommodate a shorter overall length of a blank round as compared to a live round. This is illustrated in FIGS. 11 and 12. FIG. 11 shows two blank rounds 1100 positioned in the magazine 70. FIG. 12 shows two live rounds 1200 positioned in the magazine 70. The blank rounds 1100 do not include a bullet or projectile protruding from the cartridge that makes the live rounds 1200 longer. As shown in FIG. 11, the blank rounds 1100 fit into the magazine 70 such that the stop 74 will not interfere with additional blank rounds 1100 stacked in the magazine 70. On the other hand, FIG. 12 shows that additional live rounds 1200 cannot be loaded into the magazine 70 because the two live rounds 1200 shown will interfere with the stop 74. As such, the two live rounds 1200 cannot be pressed into the magazine while loading additional rounds because the stop 74 prevents the two live rounds 1200 from moving into the magazine 70. Accordingly, it is only possible that up to two live rounds 1200 can be inadvertently loaded in the magazine 70 whereas the magazine 70 will work as intended with a full load of blank rounds 1100. If live rounds are accidentally shot, the BFA+ is well designed to capture and withstand multiple bullets from live rounds 1200 without incident.

The follower 73 has to be shortened from its normal configuration to make room for the stop 74. FIGS. 9 and 10 show that about the first ½" of the follower 73A has been bent downward to accommodate the space taken by the roller 74. Optionally, the follower 73 can be cut or fabricated in such a way to avoid interference with the stop 74 so that the follower 73 can be pressed into the magazine 70 and clear the stop 74 when blank rounds 1100 are loaded into the magazine 70.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A method of trapping a bullet fired from a firearm, comprising:

providing a gun barrel for the firearm, the gun barrel having a partially smooth bore, on the firearm;

providing a blank firing adapter plus bullet trap attached to a muzzle end of the gun barrel, the blank firing adapter plus bullet trap including a bore aligned with a longitudinal axis of the gun barrel;

arranging for a blast in the firearm to cause a bullet to travel in the gun barrel in a direction parallel to the longitudinal axis of the gun barrel toward the blank firing adapter plus bullet trap; and stopping the bullet in the blank firing adapter plus bullet trap.

2. The method of claim 1, wherein the smooth bore extends most of the length of the gun barrel.

3. The method of claim 1, wherein the blank firing adapter plus bullet trap includes a chamber to trap the bullet fired from the firearm.

4. The method of claim 1, further comprising stopping a plurality of bullets consecutively fired from the firearm.

5. The method of claim 1, further comprising allowing gas created by allowing the blast in the firearm to escape through a port of the blank firing adapter plus bullet trap.

6. The method of claim 5, further comprising adjusting a pressure of the gas by changing a size of the port.

7. The method of claim 1, further comprising providing a magazine that limits loading of up to two live rounds.

8. The method of claim 7, wherein the magazine is configured to accept a stack of blank rounds and a maximum of two live rounds.

9. The method of claim 1, further comprising ejecting a shell casing from the bullet and automatically operating the firearm to insert a new cartridge into a chamber of the firearm.

10. A method of firing a firearm, comprising:

providing a blank firing adapter plus bullet trap attached to the end of a barrel of the firearm, the blank firing adapter plus bullet trap including a bore aligned with a longitudinal axis of the barrel;

providing a magazine that limits loading of up to two live rounds; and arranging for a blast from a cartridge in the firearm to eject a shell casing from the cartridge and automatically operate the firearm to insert a new cartridge from the magazine into a chamber of the firearm.

11. The method of claim 10, wherein the blank firing adapter plus bullet trap is configured to trap one or more bullets consecutively fired from the firearm.

12. The method of claim 10, wherein the magazine includes a stop that limits acceptance of the up to two live rounds.

13. The method of claim 10, wherein most but not all of a bore of the barrel is smooth.

14. The method of claim 10, further comprising allowing gas created by the blast to escape the firearm through a port of the blank firing adapter plus bullet trap.

15. The method of claim 14, further comprising adjusting a back pressure of the gas by changing a size of the port.

* * * * *